US007028945B2

(12) United States Patent
Formon et al.

(10) Patent No.: US 7,028,945 B2
(45) Date of Patent: Apr. 18, 2006

(54) TOWEL DISPENSER WITH TEAR BAR

(75) Inventors: John S. Formon, Appleton, WI (US); Thad A. Tomlinsson, Hortonville, WI (US); Russell G. Stang, Oshkosh, WI (US)

(73) Assignee: SCA Tissue North America LLC, Neenah, WI (US)

( * ) Notice: Subject to any disclaimer, the term of this patent is extended or adjusted under 35 U.S.C. 154(b) by 0 days.

(21) Appl. No.: 10/840,352

(22) Filed: May 7, 2004

(65) Prior Publication Data

US 2006/0006277 A1 Jan. 12, 2006

(51) Int. Cl.
*B65H 75/18* (2006.01)
*B65H 35/10* (2006.01)

(52) U.S. Cl. ..... 242/593; 225/52; 225/106

(58) Field of Classification Search ..... 242/593; 225/16, 39, 46, 47, 52, 106
See application file for complete search history.

(56) References Cited

U.S. PATENT DOCUMENTS 4,275,827 A 6/1981 Cole
4,454,974 A 6/1984 Cooke
4,524,895 A * 6/1985 Lunden
4,659,028 A 4/1987 Wren
4,760,970 A * 8/1988 Larsson et al.
5,097,998 A 3/1992 Shimasaki
5,141,171 A * 8/1992 Yang
5,549,218 A 8/1996 Asmussen
5,577,634 A * 11/1996 Morand
5,762,287 A 6/1998 Schutz
6,250,530 B1 * 6/2001 LaCount et al.
6,267,322 B1 7/2001 Harmathy
6,695,247 B1 * 2/2004 Widlund
6,769,589 B1 * 8/2004 Paukov

* cited by examiner

*Primary Examiner*—William A. Rivera
(74) *Attorney, Agent, or Firm*—Young & Thompson

(57) ABSTRACT

Dispenser apparatus for sequentially dispensing sheet material from a center pull coreless roll of sheet material includes a wall-mounted housing having a bottom for supporting the coreless roll on end. A dispenser opening such as a nozzle is incorporated in the apparatus. A tear bar adjacent the nozzle creates stress at perforations that connects two adjacent sheets. When a user pulls a first sheet, the stress causes the sheets to separate. The tear bar is preferably beneath the nozzle, so that the sheets separate at the tear bar leaving an acceptable lead end of a next sheet, when the user pulls at an angle substantially 90 degrees to the wall.

10 Claims, 5 Drawing Sheets

TOWEL DISPENSER WITH TEAR BAR

TECHNICAL FIELD

This invention relates to dispenser for sequentially dispensing sheet material. The teachings of the invention are particularly applicable to the dispensing of paper toweling from center pull dispensers.

BACKGROUND OF THE INVENTION

Dispensers utilized to dispense paper toweling from center pull coreless rolls are known in the art. Such rolls include a lead end. In center pull dispenser constructions the lead end of the toweling is pulled from the center of the roll through an opening in the dispenser, typically an opening in the dispenser bottom. A dispenser element, typically a nozzle, is disposed at the dispenser bottom defining a passageway through which the toweling is pulled and which provides for or facilitates removal of individual sheets of toweling by the consumer.

While many arrangements are known in the prior art for dispensing paper toweling or tissue, such arrangements are limited by their structure as to their placement for use. Specifically, the known arrangements assume that there will be an unrestricted amount of vertical space beneath the dispenser for typical downward dispensing.

For example, U.S. Pat. No. 5,762,287 to Schutz describes a center pull towel dispenser. The type of dispenser disclosed by Schutz is a typical center pull-down dispenser wherein the paper is dispensed downwardly or vertically. Specifically, a nozzle creates friction forces on the towel causing the towel to break at perforations (or other lines of weakness) as soon as a lead end of a subsequent towel exits the nozzle. However, if a user pulls at an angle other than essentially vertical, the towel often does not tear at the perforations leaving an unacceptable lead end or tail for the next user to pull.

Attempts have been made to dispense paper products at an angle other than along the vertical. U.S. Pat. No. 5,097,998 describes a rolled paper dispenser having a hook on a side of the dispenser for engaging the paper. The user wraps the paper around the hook and then pulls on the end of the paper to tear the paper. However, this dispenser appears to have dispensing lengths that are arbitrary and thus wasteful. In addition, based on the particular design of that patent, the tail could be excessively long and could undesirably contact surrounding surfaces so that the next user would not be inclined to use this dispenser.

U.S. Pat. No. 5,549,218 describes a paper towel dispenser that dispenses paper through a slot formed between two rollers. The paper towel then extends down behind a cutter bar. The user grasps the depending paper and pulls forwardly to separate the paper. While this reference teaches dispensing toward the user, the cutter bar orientation is particular to this specific type of dispenser and could not be used for a center pull dispenser that is wall mounted and relatively compact.

Due to the limited amount of space in certain markets such as food service, where wall space is confined, the inventors of the present invention have recognized a need for a compact dispenser that can be readily mounted to any substantially vertical surface regardless of the amount of vertical space beneath the dispenser. Specifically, a need exists for a dispenser that can be mounted right next to a sink or counter surface without the height of the counter surface unduly affecting the dispensing ability of the dispenser.

DISCLOSURE OF INVENTION

An object of the present invention is to have a dispenser apparatus for sequentially dispensing sheet material from a center pull coreless roll of sheet material that can dispense the sheets at an angle other than essentially vertical.

Another object is to have a dispenser that can be mounted in an area close to a sink or counter surface without being unduly limited by the amount of available vertical space.

Still another object is to be able to modify an existing center pull geometry dispenser to include a tear bar to enable the modified existing dispenser to be used in limited space scenarios.

These objects can be achieved by having a dispenser for sequentially dispensing sheet material that includes a housing defining a housing exterior that is removably mountable to a substantially vertical surface and a housing interior including a housing bottom. The housing contains a quantity of perforated interconnected sheet material. The dispenser also preferably includes a dispenser element (either formed separately from or integrally with the remainder of the housing) located below the upper support surface and defining a passageway for receiving a lead end of a first sheet of said sheet material and a tear bar external of and preferably beneath the passageway.

Other features, advantages, and objects of the present invention will become apparent with reference to the following description and accompanying drawings.

DETAILED DESCRIPTION OF THE PREFERRED EMBODIMENTS

Figure 1:
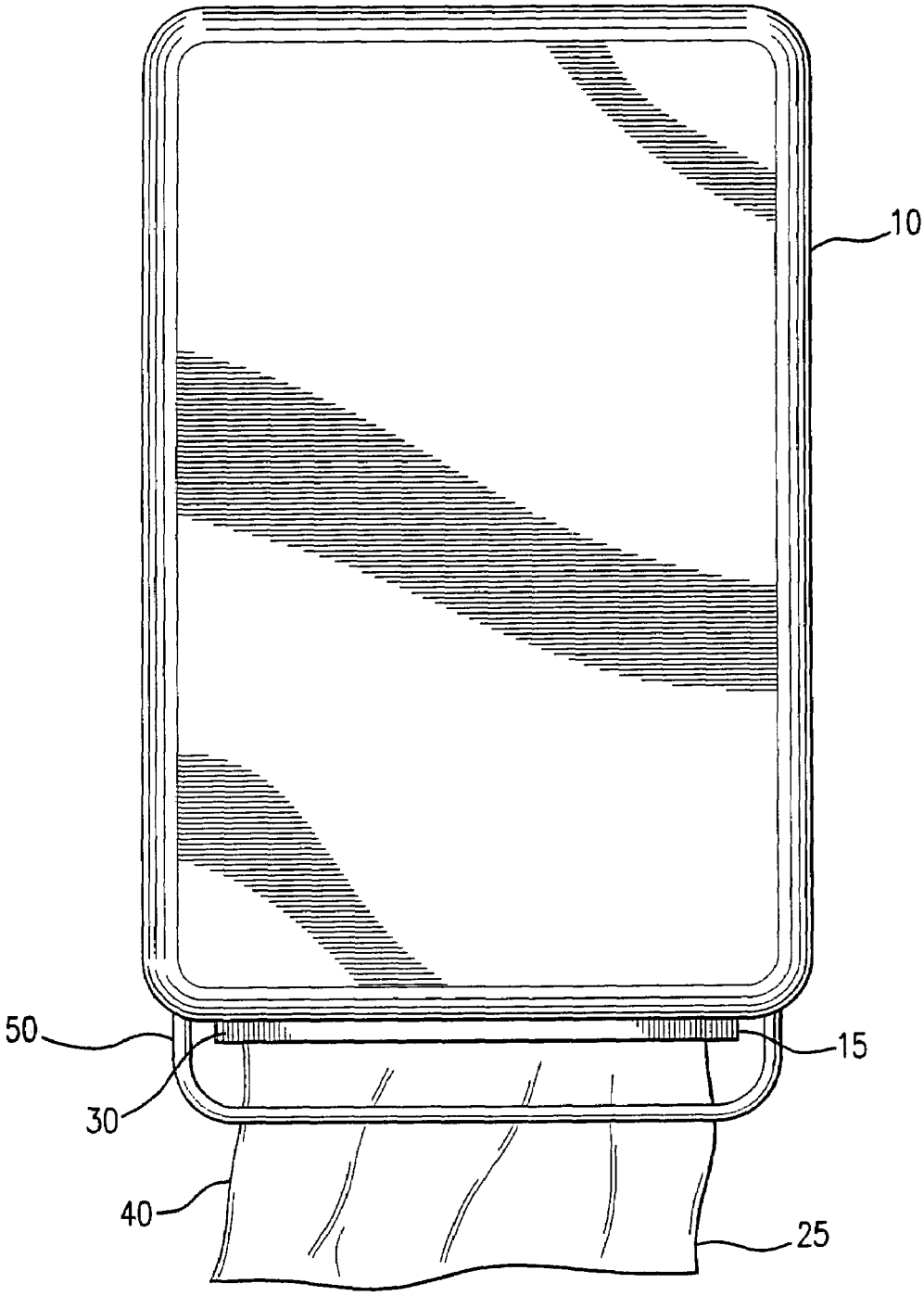
FIG. 1 is a front view of the housing of a dispenser apparatus having a tear bar constructed in accordance with a first embodiment of the present invention.
Figure 2:
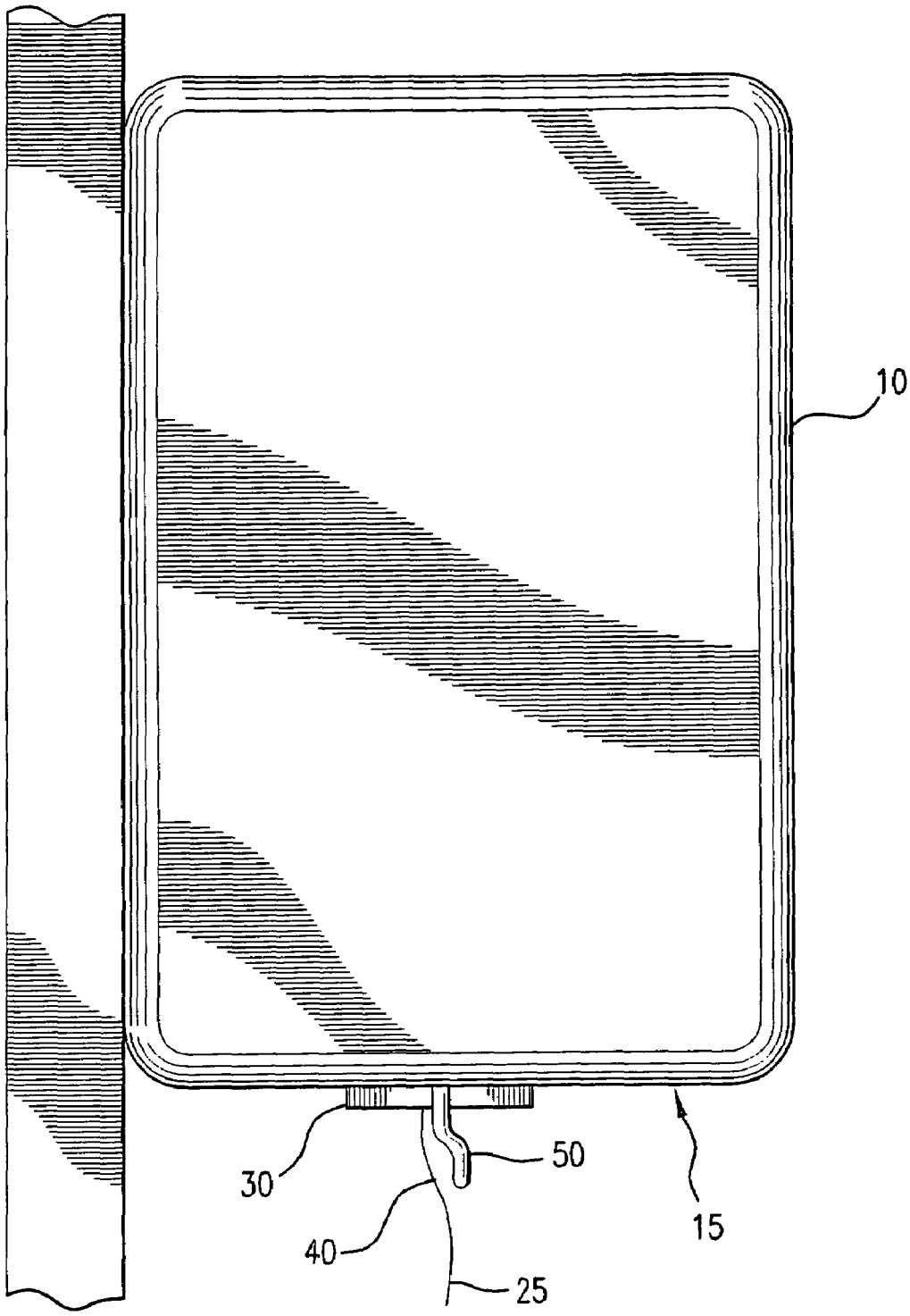
FIG. 2 is a side view of the apparatus of FIG. 1.
Figure 3:
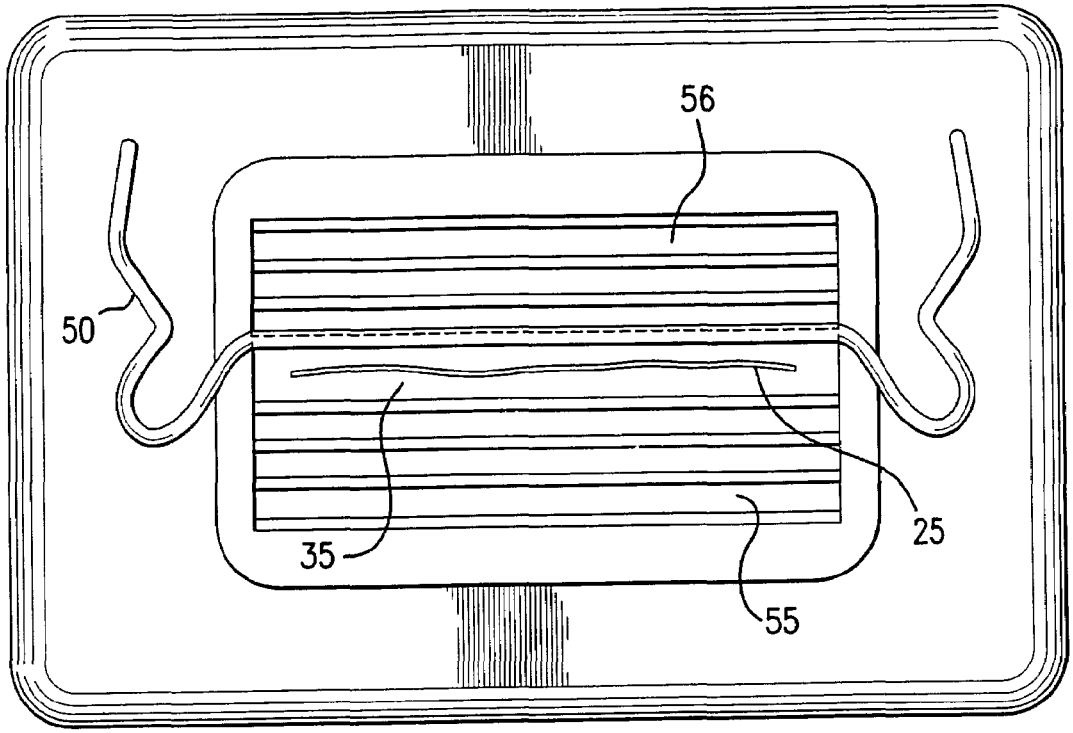
FIG. 3 is a bottom view of the apparatus of FIG. 1 showing a specific configuration of a tear bar.
Figure 4:
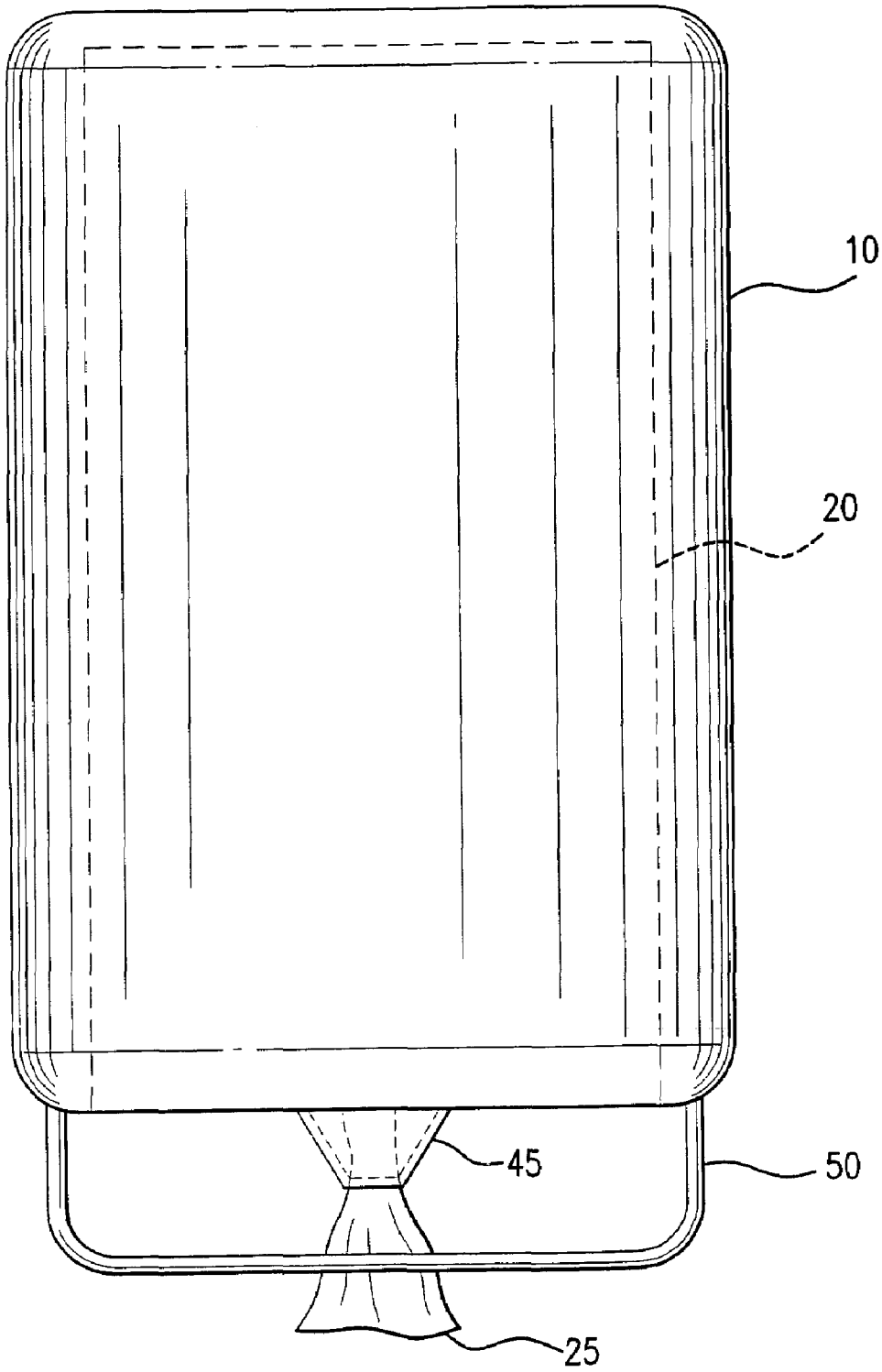
FIG. 4 is a front view of the housing of a dispenser apparatus having a tear bar constructed in accordance with a second embodiment of the present invention.
Figure 5:
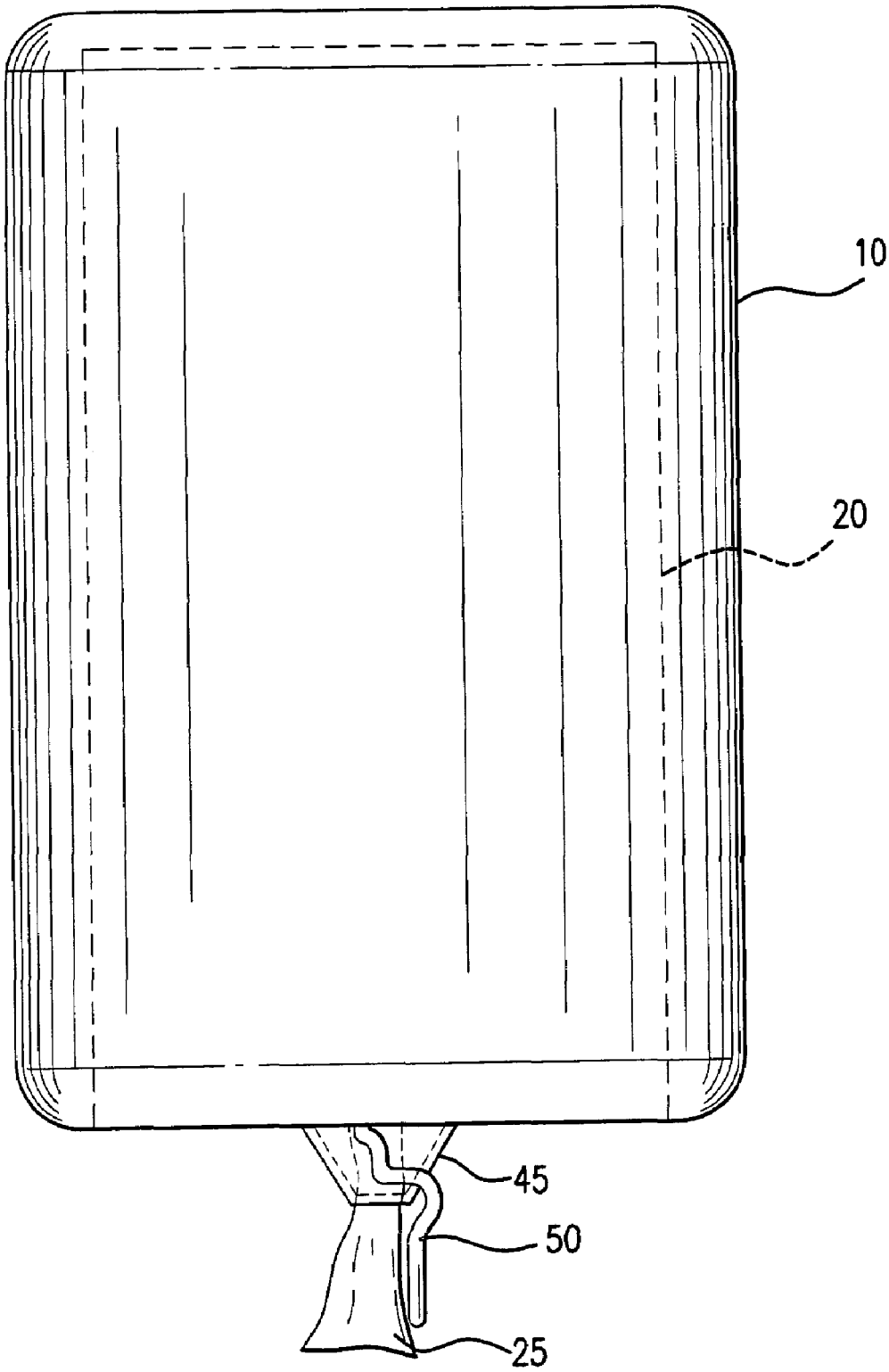
FIG. 5 is a side view of the apparatus of FIG. 3.

Referring now to FIGS. 1 through 6, the dispenser apparatus of these embodiments includes a housing 10 defining a housing exterior, a housing interior and a housing bottom 15. The housing exterior is removably mountable to a substantially vertical surface, such as a wall (as seen in FIG. 2). The housing bottom 15 supports a quantity of perforated sheet material. As seen in FIG. 4, for example, the sheet material could be on a roll 20 and the housing bottom 15 supports the roll 20 on end. The illustrated roll is a roll of paper toweling and has a lead end 25 projecting downwardly from the center of the roll 20.

As best seen in FIG. 3, the lead end 25 projects from a dispenser element 30. The dispenser element defines a passageway 35 for receiving the lead end 25 of a first sheet 40 of the sheet material. FIG. 3 shows an embodiment of a dispenser element 30 that includes a pair of rotating, meshing spur gears 55, 56. One of the gears may be spring loaded to provide a measure of resistance, facilitating the individual sheets to break off at their lines of perforation after exiting the dispenser. The pair of gears is preferably attached to a manual feed knob (not shown) providing the ability to advance the sheet if it has broken inside the dispenser 10.

As best seen in the embodiment of FIG. 4, projecting downwardly from the housing bottom 15 at a location corresponding to the center of the roll is another example of a dispenser element in the shape of a nozzle 45. In the illustrated embodiment the nozzle 45 has a truncated cone-like configuration defining an interior passageway, which diminishes in size in a downward direction. This nozzle configuration is well known in the center pull coreless towel dispensing art.

Located below the nozzle 45 and external to the passage 35 in this embodiment is a tear bar 50. Tear bar 50 provides a means for creating stress at perforations separating two consecutive sheets to be dispensed, when the sheets are dispensed in a non-vertical direction preferably substantially at 90 degrees to the wall surface.

If there is sufficient wall surface such that typical vertical dispensing will not encounter a counter top or the like, the dispenser of the present invention can also dispense towels when the towels are pulled in a substantially vertical direction.

As best seen in FIG. 2, the tear bar 50 has its tear surface forward of the sheet 40 such that the tear bar 50 is offset from a longitudinal axis of the dispenser (in a direction away from the wall). This configuration enables the lead end 25 to hang freely from the passageway 35 so that a user can grasp the lead end 25 and pull toward him or her. The tear bar 50 will create the largest stress at the point of contact of the tear bar 50 and the sheet 40 such that as the user keeps pulling, the towel will be dispensed until a weakness in the towel causes the towel to break. Such weakness is normally the perforations between two successive towels. The next towel will then have an acceptable lead end exposed for the next user to pull.

In the prior art, the edge of the nozzle or another part of the dispenser element would create the greatest stress. The stress created in the prior art dispensers would either cause the towel to break prematurely (too much stress created so that the towel does not break at the perforations) or the towel would break at the perforations, but since the break occurs at the edge of the nozzle, an unacceptable lead end would result causing the next user difficulty in dispensing a towel.

Figure 6:
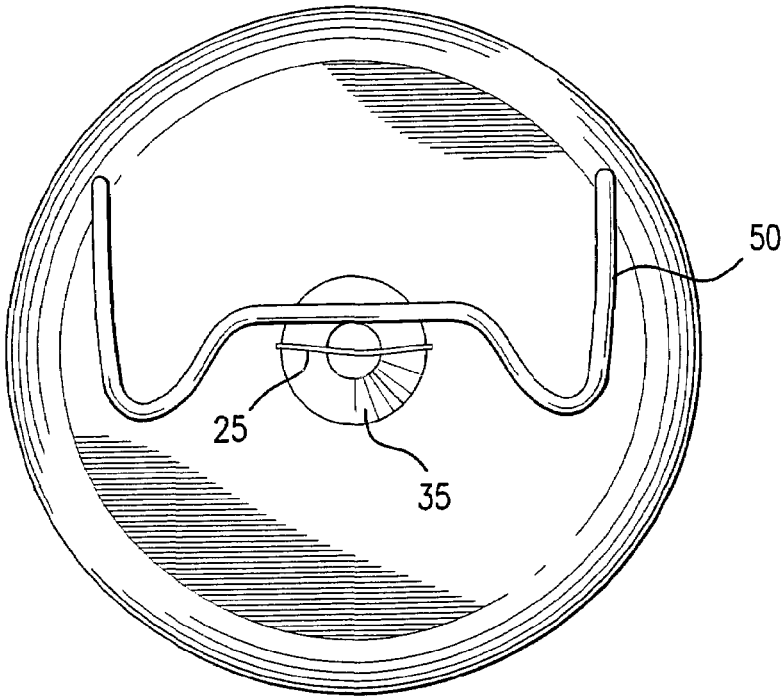
FIG. 6 is a bottom view of the apparatus of FIG. 4 showing another configuration of a tear bar.

The embodiments shown in FIGS. 3 and 6 are preferred embodiments but the shape of the tear bar 50 can be changed based on manufacturing requirements or other parameters. The tear bar shown in FIG. 3 is mounted in holes in the bottom of the dispenser 10 that are on either side of the passageway 35. Specifically, the tear bar 50 extends from a hole on one side and forward of the passageway 35 beyond the passageway 35 and then is redirected back toward a front of the dispenser 10. A portion that is substantially parallel to the wall is connected to the redirect portion and acts as a stress inducer. The tear bar then angles back toward the wall and then is redirected back toward the front of the housing and is mounted in a hole on another side of the passageway 35.

The above configuration of the tear bar 50 allows a slight damping of the forces created by the user when the towel is pulled at 90 degrees from the wall. However, the redirect portions are not necessary and the tear bar 50 could have a substantially U-shaped configuration or could even be a tongue of reasonable width extending downwardly from a bottom of the housing beyond the dispenser element 30.

As will also be appreciated by one of ordinary skill in the art, the material of construction of the tear bar is not important and metal, plastic, ceramic or carbon fiber as well as other materials readily known to those of ordinary skill in the art could also be used. As also will be appreciated by those of ordinary skill in the art, the dispenser geometry can be varied such that dispensers other than for use with coreless rolls or other than center pull dispensers can be used.

Although particular embodiments of the present invention have been shown and described, it will be obvious to those of ordinary skill in the art that various changes and modifications may be made without departing from the spirit and scope of the present invention as claimed herein.

We claim:

1. A dispenser for sequentially dispensing sheet material, said dispenser apparatus comprising:

a housing defining a housing exterior that is removably mountable to a substantially vertical surface and a housing interior including a housing bottom, said housing containing a quantity of perforated sheet material;

a dispensing opening communicating with said housing bottom and defining a passageway for receiving a lead end of a first sheet of said sheet material; and a tear bar external to and adjacent said passageway; and wherein said tear bar is substantially U-shaped having first and second legs each having a first end connected to a respective front bottom portion of said housing and a base portion between said first and second legs and terminating at a second end of said first and second legs.

2. The dispenser as claimed in claim 1, wherein said dispensing opening is formed in a funnel projecting downwardly from said housing bottom.

3. The dispenser as claimed in claim 1, further comprising a pair of rotating meshing gears feeding sheet material through said opening.

4. The dispenser as claimed in claim 1, wherein said quantity of sheet material is on a roll having a coreless geometry and said housing bottom supports said roll on end.

5. The dispenser a claimed in claim 1, wherein said tear bar is offset from a longitudinal axis of said dispenser in a direction forward of a vertical mounting surface.

6. A dispenser for sequentially dispensing sheet material from a roll of perforated sheet material, said dispenser apparatus comprising:

a housing defining a housing exterior and a housing interior including a housing bottom, said housing containing a roll of perforated sheet material;

a dispenser element defining a passageway for receiving a lead end of a first sheet of said sheet material; and a tear bar directly beneath said dispenser element and having a portion extending substantially parallel to said housing bottom.

7. The dispenser as claimed in claim 6, wherein said passageway is elongate and said tear bar has a portion that is substantially parallel to said passageway.

8. The dispenser as claimed in claim 6, wherein said passageway is funnel shaped and said tear bar has a portion that traverses a longitudinal axis going through said passageway.

9. A dispenser for sequentially dispensing sheet material, said dispenser apparatus comprising:

a housing defining a housing exterior that is removably mountable to a substantially vertical surface and a housing interior including a housing bottom, said housing containing a quantity of perforated sheet material;

a dispenser element located below the housing bottom and defining a passageway for receiving a lead end of a first sheet of said sheet material; and a means for creating stress at perforations defining a connection line between said first sheet and a second sheet, when said first sheet is being dispensed substantially perpendicular to a substantially vertical surface.

10. A dispenser for sequentially dispensing sheet material, said dispenser apparatus comprising:

a housing defining a housing exterior that is removably mountable to a substantially vertical surface and a housing interior including a housing bottom, said housing containing a quantity of perforated sheet material;

a dispensing opening communicating with said housing bottom and defining a passageway for receiving a lead end of a first sheet of said sheet material; and tear bar external to and adjacent said passageway; and wherein said tear bar has first and second legs connected to a respective front bottom portion of said housing at opposite sides of said passageway and extending in a direction toward a vertical mounting surface, a first redirect portion extending from said first leg, a second redirect portion extending from said second leg and a base portion between said first and second redirect portions.

* * * * *